US011619019B2

(12) United States Patent
AL-Hashmy et al.

(10) Patent No.: US 11,619,019 B2
(45) Date of Patent: Apr. 4, 2023

(54) AUTOMATED SYSTEM AND INSTALLATION PROCESS FOR A FLEXIBLE MAT FABRIC

(71) Applicant: Saudi Arabian Oil Company, Dhahran (SA)

(72) Inventors: Hasan Ali AL-Hashmy, Dhahran (SA); Christian Canto Maya, Dhahran (SA); Yassine Malajati, Beachwood, OH (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 157 days.

(21) Appl. No.: 17/223,692

(22) Filed: Apr. 6, 2021

(65) Prior Publication Data

US 2022/0316166 A1 Oct. 6, 2022

(51) Int. Cl.

| | |
|---|---|
| ***E02F 5/10*** | (2006.01) |
| ***E02D 3/00*** | (2006.01) |
| ***B65H 16/10*** | (2006.01) |
| ***B65H 16/02*** | (2006.01) |
| ***E02F 5/14*** | (2006.01) |

(52) U.S. Cl.

CPC ..... *E02D 3/00* (2013.01); *B65H 16/02* (2013.01); *B65H 16/106* (2013.01); *E02F 5/10* (2013.01); *E02F 5/145* (2013.01); *B65H 2402/42* (2013.01)

(58) Field of Classification Search

CPC .... E02F 5/10; E02F 5/14; E02F 5/145; E02D 17/10; B65H 2402/42

See application file for complete search history.

(56) References Cited

U.S. PATENT DOCUMENTS 2,744,042 A 5/1956 Pace
3,618,329 A * 11/1971 Hanson ..... E02F 5/12 405/179

(Continued)

FOREIGN PATENT DOCUMENTS

EP 2393970 B1 11/2017
JP 2016102313 A 6/2016

(Continued)

OTHER PUBLICATIONS

AO. Kaeding et al., ACI 548.3R-03 Polymer Modified Concrete—American Concrete Institute (ACI). 40 pages.

(Continued)

*Primary Examiner* — Benjamin F Fiorello
(74) *Attorney, Agent, or Firm* — Leason Ellis LLP

(57) ABSTRACT

A vehicle is provided for installing in a prepared area along a ground surface a protective structural support proximate a buried pipeline in an automated manner. The vehicle includes a chassis with a plurality of wheels and a payload release mechanism coupled to the chassis and including a roller for holding the protective structural support. The payload release mechanism is configured to dispense and lay down the protective structural support in the prepared area. The vehicle includes a liquid dispensing mechanism that is coupled to the chassis and is located downstream of the payload release mechanism. The liquid dispensing mechanism includes a liquid source and a dispenser that is in fluid communication with the liquid source and is configured to dispense liquid across a spray area.

31 Claims, 8 Drawing Sheets

(56) References Cited

U.S. PATENT DOCUMENTS

| | | | | |
|---|---|---|---|---|
| 4,379,655 | A * | 4/1983 | Brost | A01G 25/00 405/176 |
| 4,495,235 | A | 1/1985 | Tesch | |
| 4,872,784 | A | 10/1989 | Payne | |
| 5,765,967 | A * | 6/1998 | Klaymar | H02G 9/02 405/179 |
| 5,915,878 | A * | 6/1999 | Carpenter | E02F 5/102 405/38 |
| 6,753,061 | B1 | 6/2004 | Wedi | |
| 8,287,982 | B2 | 10/2012 | Brewin et al. | |
| 8,703,266 | B2 | 4/2014 | Crawford et al. | |
| 9,689,143 | B1 * | 6/2017 | Trussell | E02F 5/101 |
| 10,221,569 | B2 | 3/2019 | Krasnoff et al. | |
| 10,435,859 | B2 | 10/2019 | Krasnoff | |
| 2004/0137193 | A1 | 7/2004 | Wedi | |
| 2009/0158965 | A1 | 6/2009 | Andersen | |
| 2011/0206920 | A1 | 8/2011 | Ehsani | |
| 2011/0286803 | A1 * | 11/2011 | Baldinger | E02F 3/045 405/181 |
| 2012/0040161 | A1 | 2/2012 | Weidinger | |
| 2012/0118589 | A1 | 5/2012 | Quante | |
| 2012/0135202 | A1 | 5/2012 | Weidinger | |
| 2013/0011198 | A1 * | 1/2013 | Pichler | E02F 5/08 405/157 |
| 2013/0209172 | A1 * | 8/2013 | Smucker | E02F 5/02 405/38 |
| 2013/0228287 | A1 * | 9/2013 | Bessette | E04D 15/04 156/499 |
| 2016/0046396 | A1 | 2/2016 | Pinney | |
| 2016/0305085 | A1 * | 10/2016 | Ranew, Jr. | E02B 3/04 |
| 2017/0203496 | A1 | 7/2017 | Ehsani | |
| 2019/0211527 | A1 * | 7/2019 | Dunst | E02F 5/145 |
| 2019/0256418 | A1 | 8/2019 | Riley | |
| 2020/0376806 | A1 | 12/2020 | Krasnoff | |
| 2021/0018136 | A1 | 1/2021 | Vernhes | |
| 2021/0123209 | A1 * | 4/2021 | Villette | H02G 3/0406 |
| 2021/0167438 | A1 | 6/2021 | Evans | |
| 2021/0179506 | A1 | 6/2021 | Teng | |
| 2021/0396343 | A1 * | 12/2021 | Hussain | B29C 63/481 |
| 2021/0397186 | A1 * | 12/2021 | Hussain | E02F 5/32 |

FOREIGN PATENT DOCUMENTS

| | | | |
|---|---|---|---|
| KR | 101050297 | A | 12/2010 |
| WO | 2017/210068 | A1 | 12/2017 |

OTHER PUBLICATIONS

Zmij, Polymer-cement based concrete—review of properties and possibility of application in structural members, ICEUBI2017 International Congress on Engineering 2017, Portugal.

Feng, A. F. "Properties of honeycomb polyester knitted fabrics." IOP Conference Series: Materials Science and Engineering. vol. 137. No. 1. IOP Publishing, 2016.

Elsanadedy, Hussein, et al. "Effect of high temperature on structural response of reinforced concrete circular columns strengthened with fiber reinforced polymer composites." Journal of Composite Materials 51.3 (2017): 333-355.

* cited by examiner

AUTOMATED SYSTEM AND INSTALLATION PROCESS FOR A FLEXIBLE MAT FABRIC

TECHNICAL FIELD

The present invention is related to equipment that is used to installing a flexible mat fabric, such as a cementitious fabric mat, as a structural support underneath buried pipeline and as a protective structure above the pipeline against third-party damage.

BACKGROUND

Pipelines play a critical role in commercial oil and gas networks. As is known, pipeline transport is the long distance transportation of a liquid or gas through a system (network) of pipes (i.e., the pipeline). Oil pipelines are typically made from steel or plastic tubes which are usually buried. The oil is moved through the pipelines by pump stations along the pipeline. Natural gas and similar gaseous fuels are pressurized into liquids that are known as natural gas liquids. Natural gas pipelines are constructed of carbon steel.

While pipelines are generally regarded as the safest way of transporting energy products, such as oil, natural gas and other fuel products, extreme care must be taken for many reasons. According to government and industry statistics, the most common cause of pipeline incidents is improper or unauthorized digging near a pipeline. Other causes of pipeline incidents include mechanical failure, human error and corrosion. Pipelines operators carefully build, maintain and monitor the integrity and security of their lines. They invest in employee training and actively work to prevent corrosion and mechanical and human error. In addition, they work with professional excavators and homeowners to prevent unintentional damage to lines due to excavation activity.

The current installation process for pipelines takes a long time and consumes a lot of material, such as excessive usage of water, unnecessary manpower, etc. Also, there is high possibility of human errors. The prior art reported by U.S. Pat. No. 10,435,859, presented a traditional installation process in which demonstrated insufficient installation time and excessive utilization of unnecessary resource.

Moreover, the installation process of composite pipeline is a sophisticated job that requires special considerations. A clear understanding of the terrain characteristics are important in order to install a composite pipeline. A proper installation of a composite pipe requires to have an adequate soil quality to provide proper support to the pipeline. It is also important to ensure high soil quality to avoid the existence of rocks in the trench. Improper backfilling and poor soil support are installation deficiencies that make the composite pipe prone to premature failure. It was reported by the Canadian Oil and Natural Gas Producers that poor underground support in the composite pipeline represents one of the primary causes of failure mechanism in the pipe. Lack of support leads to uneven pipeline settlement in the trench causing excessive axial or shear stress in the pipe body or pipeline joints leading to premature pipeline failure. Rigid composite pipelines will require to have a flat trench bottom to avoid poor support.

Other important damage mechanism related with poor installation practices are the failures due to abrasion. Abrasion in composite pipe is caused by sharp objects, usually sharp rocks that wear the pipe external surface. The damage caused to the external resin surface leads to water filtration in the glass/resin matrix jeopardizing the mechanical strength of the pipeline and the consequent failure over time.

There is therefore a need to provide a means for protecting the pipeline against unintentional third-party damage and more specifically, an automated means for protecting the buried pipeline.

SUMMARY

The present disclosure discloses an automated installation process of a flexible fabric mat that alleviates the needs of a detailed trenching and unnecessary utilization of resources such as specialized manpower. The automated installation process of the flexible fabric mat provides ease deployment in the field of the mat with cost effective. In addition, mat installation provides a stable, flat and even surface terrain and alleviates possible bending of the composite pipelines. It also offers continuous and stable support along the line alleviating the possible flexural stresses encountered in the pipeline transitions. When the flexible fabric mat is in the form of honeycomb mat with settable material, this type of mat structure also reduces the spams due to soil settlement. The flexible fabric mat will also serve as barrier between the soil and the pipeline offering a homogeneous surface to lay down the composite pipelines. The utilization of the flexible fabric mat will entirely eliminate the problem of the sharp objects like rocks being in contact with the composite pipe eliminating the likelihood of failure due to local wear in the pipe surface. Utilizing the automated installation process of mat during the installation reduces the time of trench preparation, and accelerates the installation process.

In one embodiment, the automated process employs a vehicle for installing in a prepared area along a ground surface a protective sty structural support proximate a buried pipeline in an automated manner. The vehicle includes a chassis with a plurality of wheels and a payload release mechanism coupled to the chassis and including a roller for holding the protective structural support. The payload release mechanism is configured to dispense and lay down the protective structural support in the prepared area. The vehicle includes a liquid dispensing mechanism that is coupled to the chassis and is located downstream of the payload release mechanism. The liquid dispensing mechanism includes a liquid source and a dispenser that is in fluid communication with the liquid source and is configured to dispense liquid across a spray area. The vehicle can further include an adjustable excavating tool that is coupled to the chassis and is movable between a raised position and a lowered position.

BRIEF DESCRIPTION OF THE DRAWING FIGURES

DETAILED DESCRIPTION OF CERTAIN EMBODIMENTS

Figure 1:
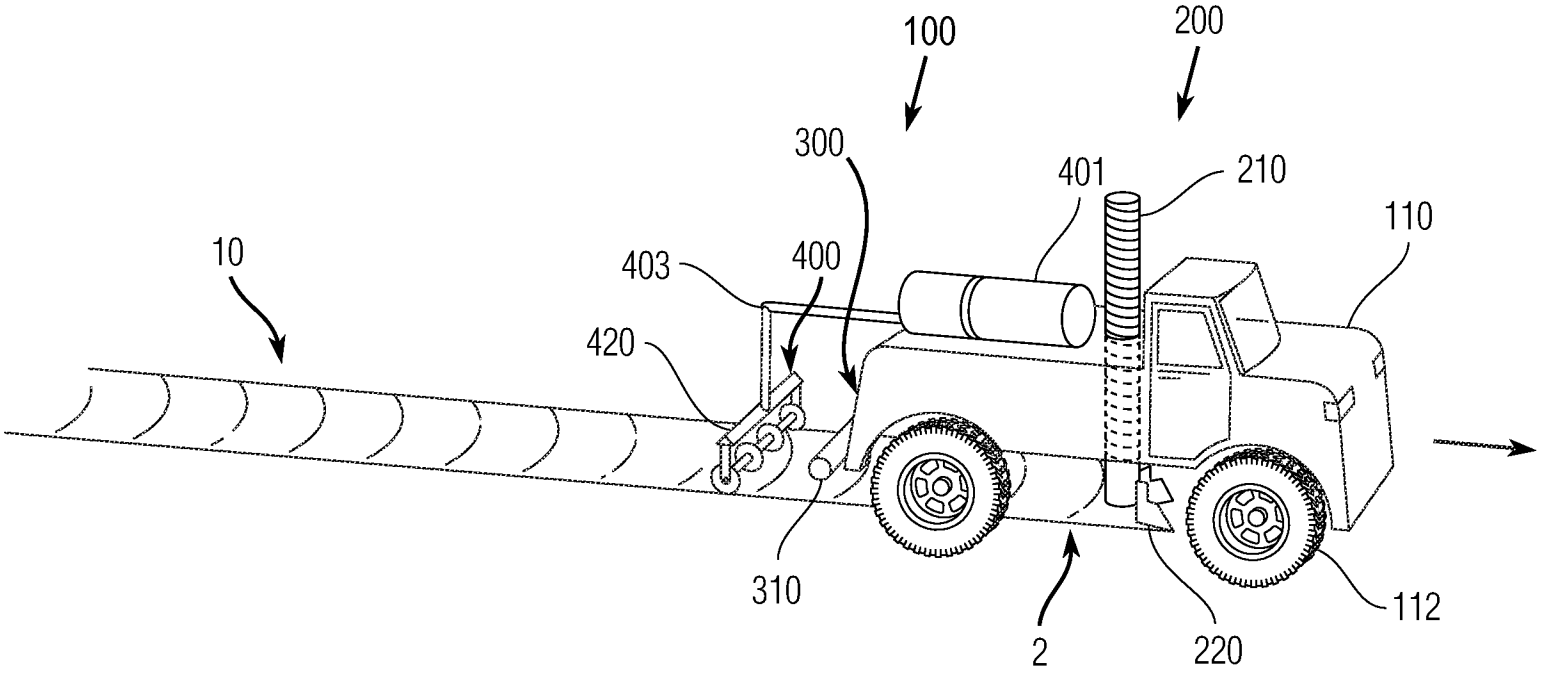
FIG. 1 is a schematic illustrating an automated system for installing a protective mat that functions as a structural support and protects a buried pipeline against third-party damage, such as unintentional excavation damage and also protects against the hazards presented by non-homogenous soil composition, such as sharp rocks, etc.

FIGS. 1-7 illustrate an automated system 100 for installing a protective mat that functions as a structural support and protects a buried pipeline 1 against third-party damage, such as unintentional excavation damage.

Flexible Protective Mat 10

In one embodiment, the protective mat comprises a flexible mat fabric 10 as described below. Suitable mat fabrics are disclosed in Applicant's previous U.S. patent application Ser. No. 17/155,971, filed Jan. 22, 2021, which is hereby expressly incorporated by reference in its entirety.

In one embodiment, the flexible mat fabric 10 can be in the form of a protective fabric mat that includes a first layer; a second layer; an intermediate spacer fabric layer; and a settable material. The intermediate spacer fabric layer is disposed between the first layer and the second layer. The first and second layers are attached to the intermediate spacer fabric layer to form a layered structure. The intermediate spacer fabric layer can comprise a flexible honeycomb or octagonal shaped spacer fabric that has a plurality of cells defined therein. The settable material is disposed within the cells and includes a cementitious mixture and one or more organic polymers and is settable to a hardened material.

In order for the flexible mat fabric 10 to set, an initiator can be used. The initiator is a liquid that causes the flexible mat fabric 10 to set. For example, the initiator can be water which as is known, is mixed with a cementitious material, in this case, the settable material, to form a hardened structure.

It will be appreciated that the flexible mat fabric 10 filled materials can be solidified in situ or in a short-time to allow easy laying and accelerate the installation process. The flexible mat fabric 10 provides flexibility required to spool for handling purpose and laying easily during the installation. When the flexible mat fabric 10 is in the form of a spacer fabric, the fiber used to form the spacer mat fabric can be high strength, such as carbon fiber (PAN or Pitch) including but not limited, to mention types of fibers as it can be glass fibers, ceramic fibers, etc. according to required application.

As described in the '971 application, the flexible mat fabric 10 can include a bottom layer 11, a spacer fabric layer 13, and a top layer 17. In one exemplary embodiment, as described in more detail herein, the flexible mat fabric 10 forms a layered structure so as to form a sandwich type structure. As also described herein, the spacer fabric layer 13 is filled with a settable material that can be hardened to a rigid or semi-rigid solid to impart desired properties to the flexible mat fabric 10.

The function of the bottom layer 11 is, at least in part, to ensure that the settable material remains held within the cells (internal spaces) of the spacer fabric layer 13. The bottom layer 11 can take any number of different forms so long as the bottom layer 11 has a construction that prevents the settable material from migrating out of the cells of the spacer fabric layer 13. The bottom layer 11 thus partially restricts (blocks) and covers the bottom access openings into the cells. The bottom layer 11 can be in the form of a woven structure of a non-woven structure that is disposed along a bottom layer (bottom face) of the spacer fabric layer 13. The bottom layer 11 can be formed from any number of different materials including but not limited to synthetics (polymeric materials), etc. For example, the material for the bottom layer 11 can be natural or synthetic fibers, including but not limited to high strength and high modulus fibers, such as carbon fibers (PAN or pitch based), aramid fibers (e.g., Kevlar, Nomex, etc.), polyolefin fibers, such as ultra-high molecular weight polyethylene (UHMWPE), of glass fibers, ceramic fibers, etc. The selection can be in view of the intended application.

The bottom layer 11 can be attached to the spacer fabric layer 13 using any number of traditional techniques, including the use of bonding agents and/or the use of stitching in that the bottom layer 11 can be stitched to the spacer fabric layer 13. Stitching the bottom layer 11 to the spacer fabric layer 13 effectively joins the two structures.

As shown in the figures, the bottom layer 11 can have a net or screen-like construction. In other words, the bottom layer 11 can have a mesh construction. The mesh size is selected so that the settable material in its final hardened state is maintained within the spacer fabric layer 200 and is not permitted to fall through the mesh construction.

The function of the top layer 17 is, at least in part, to ensure that the settable material remains held within the cells of the spacer fabric layer 13. The top layer 17 can take any number of different forms so long as the top layer has a construction that prevents the settable material from migrating out of the cells of the spacer fabric layer 13. The top layer 17 thus at least partially restricts (blocks) and covers the top access openings into the cells. The top layer can be formed of the same material as the bottom layer 11 or the two can be formed of different materials. For example, the top layer 17 can be in the form of a woven structure of a non-woven structure that is disposed along a top layer (top face) of the spacer fabric layer 13.

The top layer 17 can be attached to the spacer fabric layer 13 using any number of traditional techniques, including the use of bonding agents and/or the use of stitching in that the top layer can be stitched to the spacer fabric layer 13.

The spacer fabric layer 13 is the functional layer in that, as described herein, the spacer fabric layer 13 contains functional material that is located within the spacer fabric for providing desired properties (material characteristics) to the overall fabric mat 10.

The intermediate spacer fabric 13 preferably takes the form of a flexible honeycomb shaped spacer fabric that is stitched in knit, mat, or plain woven fabric, including, but not limited to, stitching so as to form a 2D or 3D textile configuration. Any number of other stitching techniques (styles) can be used such as twill, sating, triaxle, uniaxial, etc. The flexible honeycomb spacer fabric 13 thus defines a plurality of cells 15 that represent the hollow interiors of the honeycomb wall structure. The shape (e.g., octagonal) of each cell 15 is determined by the shape of the wall structure that defines the cell 15.

The fiber used to form the flexible honeycomb spacer fabric can be a high thermal resistance material, such as carbon fiber, or a fire resistant material, such as aramid fibers known in the industry as Kevlar®. Other fibers that can be used to form the spacer fabric include but are not limited to glass fibers, ceramic fibers, etc., based on the given application.

The space (cells 15) within the honeycomb structure (the spacer fabric layer 13) is filled with the desired materials (e.g., settable material described below) during the preparation process then the top layer (cover) is attached (e.g., stitched) to accommodate the filled materials.

Figure 7:
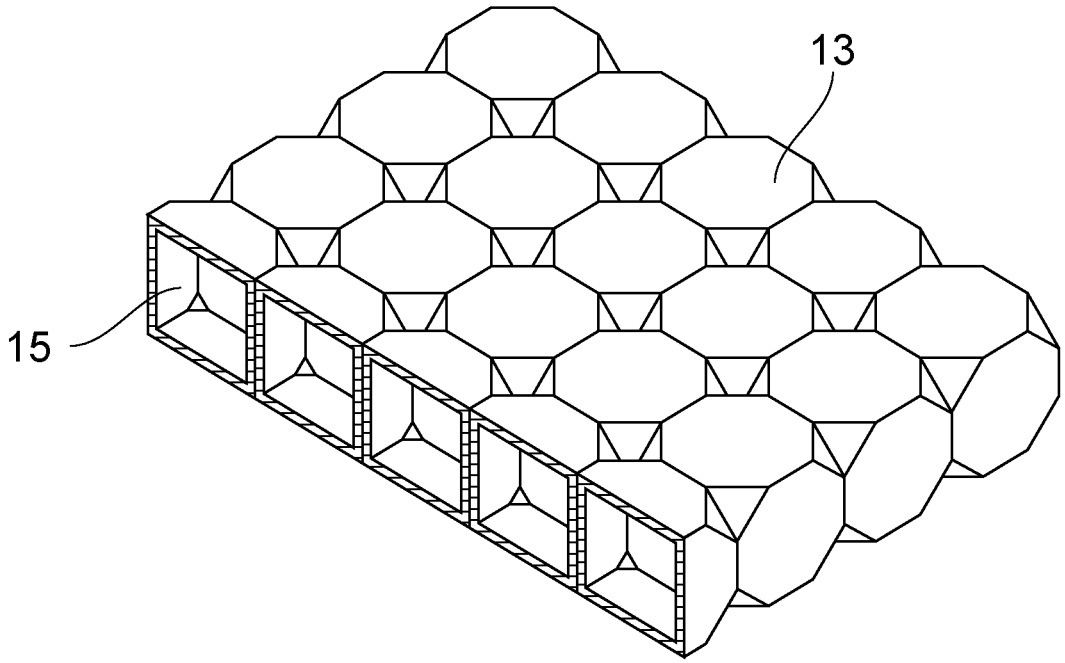
FIG. 7 is a side and top perspective view of the spacer fabric layer shown in partial cross-section.

As mentioned herein, the flexible mat fabric 10 that is preferably filled with settable materials can have an octagonal shape in that it is in the form of an octagonal shaped fabric. FIG. 7 shows the flexible mat fabric structure shaped in a 3D octagonal geometry.

Figure 5:
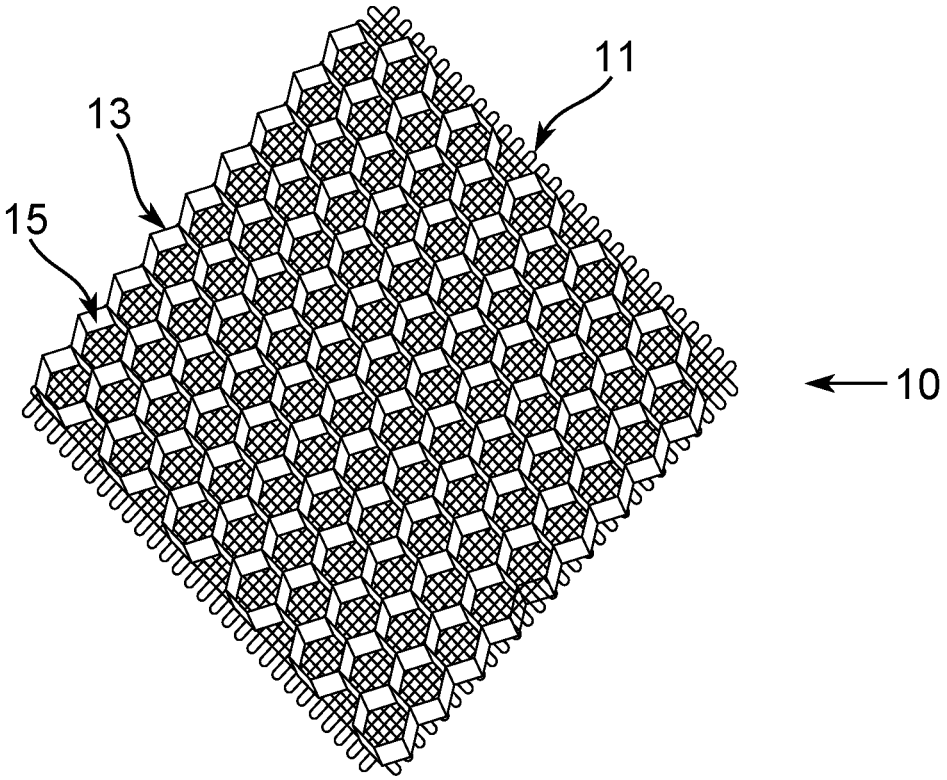
FIG. 5 is a top and side perspective view of a flexible mat fabric including a bottom layer and a spacer fabric layer.
Figure 6:
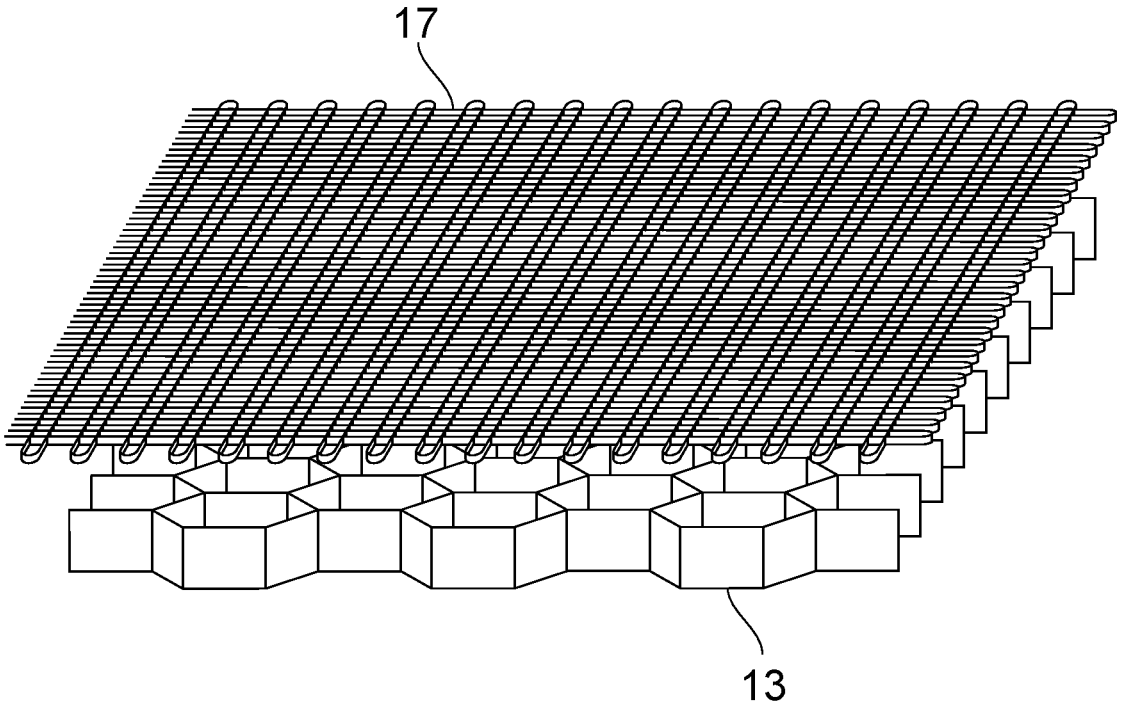
FIG. 6 is a perspective view of a top layer and the spacer fabric layer.

In this embodiment, the fabric mat fabric 10 can have a closed cell structure as opposed to the open cell structure that has been described and illustrated herein (e.g., FIG. 5). In FIG. 7, the closed cell structure can be in the form of octagonal shaped cubes. These closed cell structures are filled with the settable materials that are described herein much like how the spacer fabric 200 is filled.

The flexible honeycomb spacer fabric 13 can be and is preferably filled with one or more settable materials which can provide the desired equipment a guard required to prevent them from external thermal effect, external damage (third-party) and external fire incidence. In other words, the settable materials impart desired properties to the spacer fabric by being filled within the cells 202. The flexible honeycomb spacer fabric 13 provides the flexibility required to wrap and cover the desired equipment or object, such as a pipe, tank, etc. At the same time, the flexible honeycomb spacer fabric 13 contains and holds the settable materials filled therein within the cells 154.

The cells 15 of the spacer fabric are filled with a settable material that can be hardened to a rigid or semi-rigid solid on the addition of a setting agent, such as water or a waterborne solution, or on carbonation reactions with carbon dioxide (CO2), or on exposure to heat, UV radiation, IR radiation, etc. The settable material can be a powder material composed of fine, medium and coarse construction aggregates, such as sand, crushed stone, gravel, slag, recycled concrete, etc.) that are bound with a hydrolic cement that is capable of setting and hardening by hydration reactions when water is added into it (e.g., Portland cements). The settable materials can also comprise non-hydrolic cement that can be hardened by carbonation reactions with carbon dioxide.

As will be appreciated, the cementitious mixture is capable of in-situ hydration (i.e., hydration in place, on location, on a construction site). In-situ hydration occurs as a liquid, such as water, is topically applied and reacts with a volume of cementitious material within a cementitious composite that is defined by the spacer fabric layer 200 and the settable materials including in the cells. Hydration of cementitious composite mats (e.g., mat or jacket 100) can be initiated in-situ (e.g., in place, on a job site, etc.). The cementitious composite mat may be transported to an install location as a flexible composite material in a prepackaged configuration (e.g., sheets, rolls, etc.) and hydrated on-location as by adding a setting agent, such as water.

The settable material can also be a polymer modified cementitious mixture composed of cement mixed with one or more organic polymers that are dispersed or redispersible in water, with or without aggregates, capable of hardening and setting. The organic polymer can be a homopolymer, a copolymer when two or more monomers are copolymerized, or a mixture of two or more polymers (homopolymers and/or copolymers). Several polymers can be used for such application, including but not limited to, synthetic elastomeric latexes (e.g., polyvinyl acetate, polyacrylic esters, styrene-acrylics, vinyl acetate copolymers, polypropylene, polyvinylidene, chloride copolymers, etc.); thermosetting latexes (e.g., asphalt, paraffin, coal-tar, etc.) can be used. The organic polymers used for such application are generally produced by polymerization, mainly emulsion polymerization of the monomers in presence of water, a surfactant, and an initiator that generates free radicals and makes the monomers polymerize. Other components can be used in the polymerization process, such as antifoaming agents (e.g., silicone-based defoamers, or other non-silicone defoamers such as fatty esters or, alcohols, ethylene glycol/propylene glycol based defoamers, etc.), plasticizers (e.g., e.g., phthalates, dibenzoates, polycarboxylates, lignosulphonates, etc.), or other additives can be used to control molecular weight, etc.

Several monomers can be used to form the polymer products described herein including but not limited to styrene, vinyl acetate, acrylate esters (such as n-butyl acrylate, 2-ethyhexyl acrylate, ethyl acrylate, methyl methacrylate, etc.), acrylonitrile, acrylamide, butadiene, vinylidene chloride, vinyl chloride, ethylene, etc.). The purpose of introducing polymers into the settable materials, is to enhance their performance and properties compared to conventional concrete and mortar where for example microcracks can occur more easily under stress.

Organic polymers can be used as a dispersion in water (i.e., latex), a redispersible powder, or a water soluble or redispersible liquid. In some instances, monomers can be added to the cement and can be polymerized in-situ by adding the setting agent (e.g., water). Redispersible polymer powders are mainly used by dry mixing with the cement and aggregate premixes followed by wet mixing with water where the redispersible powders are re-emulsified. This results in hardening of the material to a rigid or semi-rigid solid. In one embodiment, one preferred optimal polymer content is achieved at polymer-to-cement ratios (p/c) between about 5 and about 20 weight (wt.) % but depending on the application and targeted properties, these ratios can go up to about 40 wt. %.

In polymer-modified concrete and mortar, aggregates are bound in a polymer-cement co-matrix where polymer phase and hydrated cement phase interpenetrate resulting in higher performance and superior properties compared to conventional concrete and mortar where microcracks can occur easily under stress mainly due to the fact that calcium silicates hydrates and calcium hydroxide are bound with weaker Van der Waals forces, which leads to poor tensile strength and fracture toughness. In contrast, when organic polymers are added, the organic polymers fill and close the gap and pores, seal the microcracks and therefore prevent their propagation, which leads to higher strength (tensile and flexural) and fraction toughness of the polymer-modified concrete or mortar. The use of organic polymers leads also to the improvement of numerous properties of the concrete and mortar, such as the hardness, barrier properties and permeability, etc. In general, these improvements ten to increase when the polymer content increases, as the porosity tends to decrease when the polymer-to-cement ratio increases.

Other additives can be used with the organic polymer to enhance certain properties, such as thermal and UV resistance, flammability, impact resistance, etc., including but not limited to UV absorbers (e.g., benzotriazole, HALS, etc.); antioxidants (e.g., phenolics, phosphites, etc.); impact modifiers (acrylics, styrenic copolymers, synthetic rubbers, etc.); flame retardants (FRs) (e.g., halogenated FRs, phosphorous FRs, nitrogen-containing FRs, such as melamine, melamine cyanurate, etc. and inorganic FRs, such as aluminum hydroxide magnesium hydroxide, antimony trioxide, etc.). Intumescent flame retardants can also be used by mixing an acid source, such as ammonium polyphosphate, a blowing agent, such as melamine and a carbon source, such as a polyol.

Nanoparticles, such as carbon nanotubes (CNT), polyhedral oligomeric silsequioxanes (POSS), nanosilica, organoclay, etc., can also be used as an additive.

Automated System 100

The automated system 100 includes a vehicle 110, such as a truck, that has a chassis with wheels (tires) 112 and an engine. The vehicle 110 has a rear portion 120 that acts as a payload and contains many of the working components of the system 100. As described herein, the system 100 is designed to automatically install the protective mat 10 relative to the buried pipeline 1 as the vehicle 110 travels over the prepared area in which the pipeline 1 is laid.

The automated system 100 includes a main controller 50 that permits the user to control various aspects of the operation of the automated system 100. In particular, the main controller 50 is in communication with a plurality of the individual components (mechanisms) that are described herein that are used in conjunction to automatically install the flexible mat fabric 10 in the excavated area.

In one aspect, the system 100 can be of a type that communicates over a communications network 90 to allow the various components to speak with the main controller 50 and/or to communicate directly with one another.

Figure 4:
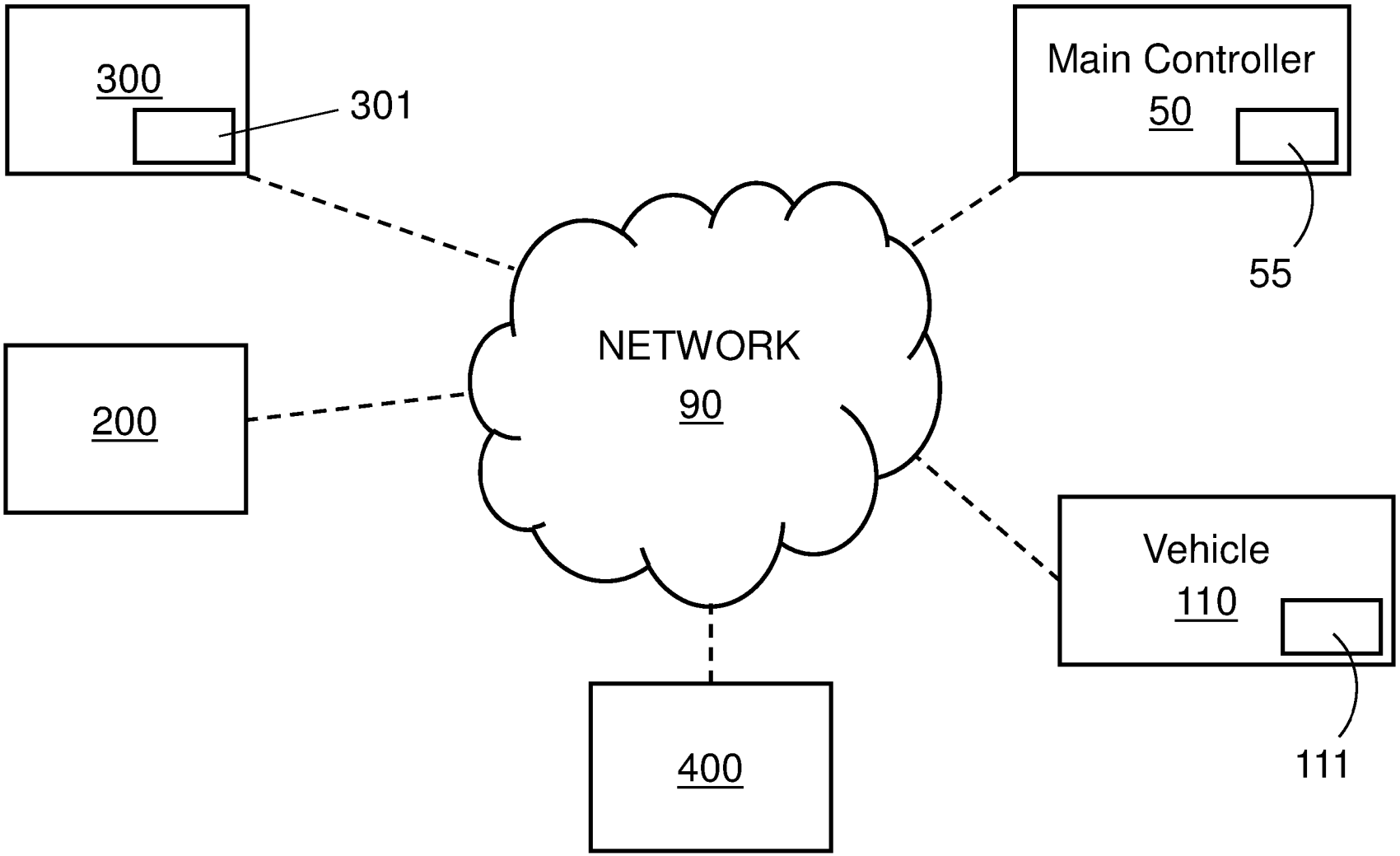
FIG. 4 is a schematic showing exemplary electronics of the automated system.

With continued reference to FIG. 4, various forms of computing devices are accessible to the network 90 and can communicate over the network 90 to the various machines that are configured to send and receive content, data, as well as instructions that, when executed, enable operation of the various connected components/mechanisms. The content and data can include information in a variety of forms, including, as non-limiting examples, text, audio, images, and video, and can include embedded information such as links to other resources on the network, metadata, and/or machine executable instructions. Each computing device can be of conventional construction, and while discussion is made in regard to servers that provide different content and services to other devices, such as mobile computing devices, one or more of the server computing devices can comprise the same machine or can be spread across several machines in large scale implementations, as understood by persons having ordinary skill in the art. In relevant part, each computer server has one or more processors, a computer-readable memory that stores code that configures the processor to perform at least one function, and a communication port for connecting to the network 90. The code can comprise one or more programs, libraries, functions or routines which, for purposes of this specification, can be described in terms of a plurality of modules, residing in a representative code/instructions storage, that implement different parts of the process described herein. As described herein, each of the robotic devices (tools) has a controller (processor) and thus, comprises one form of the above-described computing device.

Further, computer programs (also referred to herein, generally, as computer control logic or computer readable program code), such as imaging or measurement software, can be stored in a main and/or secondary memory and implemented by one or more processors (controllers, or the like) to cause the one or more processors to perform the functions of the invention as described herein. In this document, the terms "memory," "machine readable medium," "computer program medium" and "computer usable medium" are used to generally refer to media such as a random access memory (RAM); a read only memory (ROM); a removable storage unit (e.g., a magnetic or optical disc, flash memory device, or the like); a hard disk; or the like. It should be understood that, for mobile computing devices (e.g., tablet), computer programs such as imaging software can be in the form of an app executed on the mobile computing device.

The system 100 can include a graphical user interface (GUI) 55 that can be provided to allow for remote control over the system 100. As is known, the GUI 55 is a system of interactive visual components for computer software. A GUI displays objects that convey information and represent actions that can be taken by the user. The objects change color, size, or visibility when the user interacts with them. GUI objects include icons, cursors, and buttons. These graphical elements are sometimes enhanced with sounds, or visual effects like transparency and drop shadows.

The graphical user interface 55 typically includes a display, such as a touch screen display to allow user input to be registered and then steps are taken by the main processor 50.

Excavating Tool 200

In one aspect, the vehicle 110 has the excavating tool 200 that is configured to excavate the ground in which the pipeline 1 is laid. The excavating tool 200 is thus configured to dig a ditch 2 in the ground as the vehicle 110 travels along the ground. In other words, the ditch 2 is automatically dug in the ground as the vehicle 110 travels along the ground. The ditch 2 is thus a continuous structure that is formed for a desired length along the ground.

Any number of suitable excavating tools 200 can be used to form the ditch 2. In the illustrated embodiment, the excavating tool 200 comprises a shaft 210 that is held in a vertical orientation within the vehicle 110. At a bottom end of the shaft 210 there is an excavating knife 220 that is configured to excavate the ground and form the ditch 2 as the vehicle 110 travels.

The excavating tool 200 is adjustable and more specifically, the excavating tool 200 can be adjusted in a vertical direction to vary the depth of the ditch 2 that is formed in the ground. This adjustment can be motorized (e.g., linear actuator powered by a motor) in that the user can raise and lower the excavating tool 200 using user controls that control operation of the motor, thereby raising or lowering the excavating tool 200. In addition, there is an up position in which the excavating tool 200 is completely up and not in contact with the ground. It will be appreciated that in a more raised position, the ditch 2 is shallower, whereas, in a more lowered position, the ditch 2 is deeper. The width of the excavating knife 220 defines the width of the ditch 2.

The excavating tool 200 is located between the wheels 112. As mentioned, the user can control operation of the excavating tool 200 by a user controller which can take any number of different forms, such as one or more actuators (e.g., switches, buttons, levers, etc.) or can be a digital graphical user interface (touch screen).

Payload Release Mechanism 300

In another aspect of the system 100, the vehicle 110 includes the payload release mechanism 300 for controllably releasing the flexible mat fabric 10 from the vehicle 110. The flexible mat fabric 10 is typically provided in rolled form which facilitates its unrolling from the vehicle 110 as the vehicle 110 travels over the ground surface. The flexible mat fabric 10 can thus be wound about a core (e.g., a tube). The flexible mat fabric 10 is intended to be laid into the excavated ground (e.g., trench) that is prepared by the excavating tool 200. The flexible mat fabric 10 is thus preferably dimensioned to occupy a substantial area of the excavated ground. For example, the width of the flexible mat fabric 10 can be at least 50%, at least 75%, at least 90% or at least 95% of the width of the excavated ground (e.g., trench). Since the flexible mat fabric 10 is intended to shield and protect a pipeline that is laid in the trench, the flexible mat fabric 10 should be wider than the pipeline diameter since the flexible mat fabric 10 that is first laid into the trench is intended to surround and protect at least a bottom portion of the pipeline.

The payload release mechanism 300 is located downstream from the excavating tool 200 and can be located at the rear of the vehicle 110 since it should be located where it can easily dispense and lay the flexible mat fabric 10 into the trench. In the illustrated embodiment, the payload release mechanism 300 is located at the rear of the vehicle 110 and can be supported on a rear frame that is at the rear of the vehicle 110. The payload release mechanism 300 can thus be in the form of a roller 310 that hold the roll of flexible mat fabric 10 and allows the flexible mat fabric 10 to be dispensed rearwardly away from the vehicle 110. The core of the flexible mat fabric 10 can thus be inserted over the roller. The roller 310 can be attached to the rear frame in such away that allows the rolled flexible mat fabric 10 to be easily inserted over the roller and removed from the roller 310 when all of the flexible mat fabric 10 has been dispensed. In other words, the roller 310 can disengaged from the rear frame.

In one aspect, the payload release mechanism 300 can be motorized and automated such that it can be controlled by the user inside the vehicle 110. For example, a motor 301 can be operatively coupled to roller 310 such that the operation of the motor is translated into rotation of the roller 310. Motorized rotation of the roller 310 in a first direction causes unwinding of the rolled flexible mat fabric 10. In the event that for some reason the flexible mat fabric 10 needs to be wound up, the motor 301 operates in an opposite second direction. The motor is operatively connected to a main controller 50 to allow the user to control operation of the payload release mechanism 300. For example, the main controller 50 allows the user to not only turn the payload release mechanism on or off but also can allow the user to control the speed to the dispensing action by controlling the rotation speed of the roller 310. The main controller 50 and/or user interface 55 that allows for the control over the payload release mechanism 300. The user interface 55 can be completely digital or can be an analog system that includes actuators (e.g., buttons, levers, etc.) or can be a combination thereof. For example, to begin dispensing of the flexible mat fabric 10, a lever or the like can be moved to a dispensing state causing the unrolling of the flexible mat fabric 10.

The payload release mechanism 300 can include one or more guides that direct the dispensing of the flexible mat fabric 10. For example, the one or more guides can comprise sloped surfaces over which the flexible mat fabric 10 travels after it leaves the roller 310 on its way to the excavated ground. Alternatively, the one or more guides can comprise guide slots through which the flexible mat fabric 10 is fed.

As described herein, the flexible mat fabric 10 is intended to be laid not only under the pipeline but also above the pipeline so as to substantially cover and protect the pipeline from third party acts such as accidental digging, etc., and also eliminates the problem of the sharp objects like rocks being in contact with the composite pipe eliminating the likelihood of failure due to local wear in the pipe surface. Utilizing the automated installation process of mat during the installation reduces the time of trench preparation, and accelerates the installation process.

In another embodiment, the speed of the payload release mechanism 300 is at least in part controlled by the speed of the vehicle 110. For example, the master controller 50 can receive as an input the speed of the vehicle 110, such as from the speedometer mechanism 111 of the vehicle 110. Based on this vehicle speed input, the master controller 50 then controls the speed of the payload release mechanism 300. For example, if the vehicle 110 is traveling too fast and the payload release mechanism 300 is not compensating for such release of the flexible mat fabric 10, then the flexible mat fabric 10 will not be properly laid in the ditch 2. Thus, the speed of the vehicle 110 must be within a target range for proper operation of the payload release mechanism 300 or the payload release mechanism 300 must be of an adaptive type that will adapt to the vehicle speed. For example, the main controller 50 (processor) can include software that includes an algorithm that computes the optimal speed of the payload release mechanism 300 based on the measured speed of the vehicle 110. This software is stored in memory.

As is known, most speedometers today are electronic speedometers that have small magnets attached to the car's rotating drive shaft that sweep past tiny magnetic sensors (either reed switched or Hall-effect sensors) positioned nearby. Each time the magnets pass the sensors, they generate a brief pulse of electric current. An electronic circuit counts how quickly the pulses arrive and converts this into a speed, displayed electronically on an LCD display or the like. This vehicle speed information is then transmitted to the main controller 50.

Liquid Dispensing Mechanism 400

The vehicle 110 also includes the liquid dispensing mechanism 400 that is positioned and configured to controllably dispense a liquid onto the flexible mat fabric 10. In view of this objective, the liquid dispensing mechanism 400 is positioned downstream of the payload release mechanism 300. The liquid dispensing mechanism 400 is intended to dispense (spay) liquid across a substantial width of the flexible mat fabric 10 as means for wetting the flexible mat fabric 10. The liquid dispensing mechanism 400 can thus be thought of as being a spray mechanism that sprays liquid downward onto the flexible mat fabric 10.

For example, the liquid dispensing mechanism 400 can be formed of a frame that is coupled to the vehicle 110 (rear of) and includes a dispenser 420 that is coupled to the frame and includes one or more nozzles or orifices or vents 430 for dispensing the liquid in a direction preferably toward the flexible mat fabric 10. The nozzles 430 are spaced apart from one another across the length of the dispenser 420. As discussed herein, the liquid can be in the form of water that is sprayed (dispensed) onto the flexible mat fabric 10.

The liquid dispensing mechanism 400 includes a liquid source 401 that provides the liquid that is dispensed through the liquid dispensing mechanism 400. For example, the liquid source 401 can be in the form of a tank. The tank can be mounted to the vehicle 110 such as along the top of the vehicle 110 as illustrated. A conduit 403 connects the liquid source 401 to the dispenser 420. The conduit 403 can be in the form of a tube or the like in which the liquid flows to the dispenser 420. It will also be appreciated that a flow controller (not shown), such as a valve, can be provided along the conduit 403 to control the flow of the liquid through the conduit 403. The flow controller can be in communication with the main controller 50 to allow the user to control the operating state of the flow controller.

The water (or specialized liquid) can be compressed in order to allow water drops spraying evenly on the flexible mat fabric 10.

In one embodiment, the flow controller has two operating state, namely, on or off. While the flow controller can be of a type in which the flow rate of the liquid is controllable, such control is typically not necessary since the simpler on and off operating states suffice.

In one embodiment, the master controller 50 can be configured such that when the payload release mechanism 300 is actuated, the liquid dispensing mechanism 400 is likewise actuated. In this embodiment, the user simply actuates the payload release mechanism 300 and this causes the flexible mat fabric 10 to be unwound and simultaneously causes the dispensing of the liquid through the liquid dispensing mechanism 400.

The liquid dispensing mechanism 400 can include other features such as a low level sensor (not shown) that is within the tank (liquid source 401) to alert the user about a low liquid level condition.

In another embodiment, the dispenser is configurable in that the spray pattern of the dispenser can be selected by the user. For example, the spray pattern can be selected in view of the width of the flexible mat fabric 10. For example, not all of the nozzles 430 need to be open if the flexible mat fabric 10 is of smaller size (smaller width). Using the main controller 50, the user can select the size of the flexible mat fabric 10 that is being used and based on this user input, the main controller 50 can control the operation of the dispenser. For example, some of the nozzles 430 can be opened or be closed based on the user input. The user interface 55 can be used to input this information (i.e., the size of the flexible mat fabric 10). It will also be appreciated that a spray angle of the nozzles 430 can be selected and varied by user input with the main controller 50.

Imaging Equipment

The vehicle 110 can also include one or more imaging devices, such as a camera, that allows the outside environment to be viewed. For example, one camera can view the excavation area at which the excavation tool 200 is located to allow the operator to view the excavation process. In addition, one or more cameras can be mounted to the rear of the vehicle 110 to view rearwardly. This view allows the operator to view the laying down of the flexible mat fabric 10 and the operation of the liquid dispensing mechanism 400. The live feed from the one or more cameras can be displayed on a display (screen) in the cabin of the vehicle 110.

Installation Process

Figure 2:
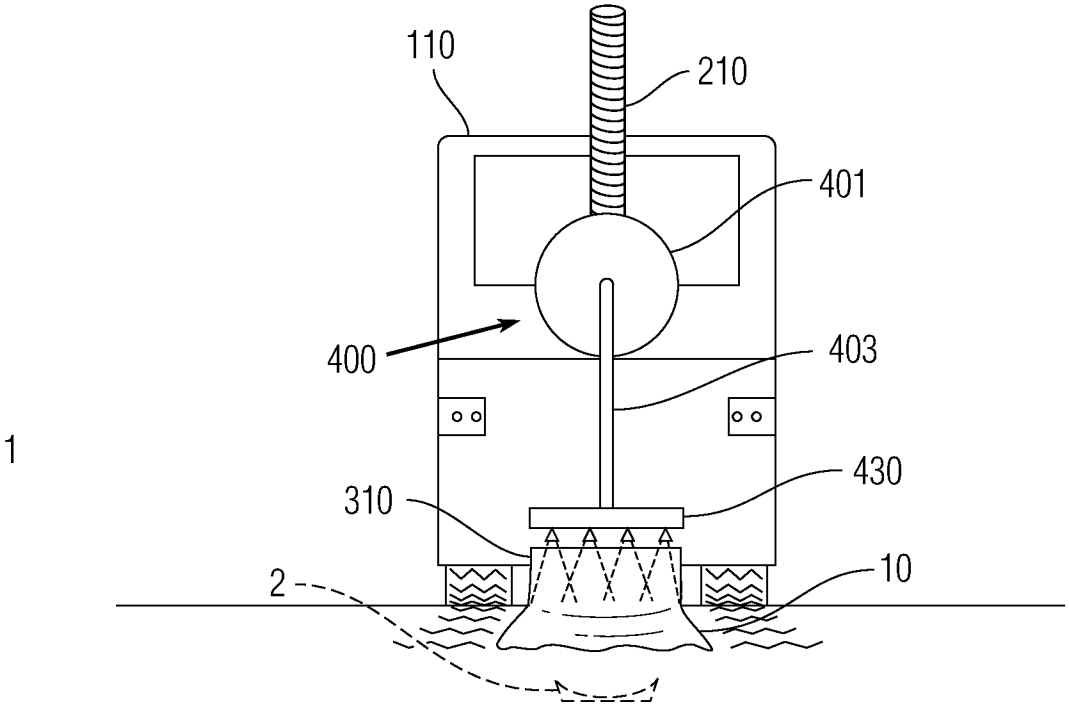
FIG. 2 is a schematic, in partial cross-section, of the automated system showing a first stage of operation.

First Stage of Operation (FIGS. 1 and 2)

The installation process typically comprises the laying of the flexible mat fabric 10 first within the ditch 2. To accomplish this, the vehicle 110 is positioned at the proper location at which the pipeline 2 is to be laid. Depending upon certain parameters, such as the diameter of the pipeline 2, the ground makeup (soil composition), the excavating tool 200 is lowered to make contact with the ground surface sufficient to excavate and create the ditch 2. The ditch 2 is thus formed to have a prescribed depth.

The payload release mechanism 300 is then actuated to cause the unrolling of the flexible mat fabric 10 into the ditch 2. As mentioned, one flexible mat fabric 10 is positioned at the bottom of the ditch 2 beneath the pipeline 2 that is to be laid into the ditch 2. This first laid flexible mat fabric 10 is intended to protect the bottom of the pipeline 2. The flexible mat fabric 10 extends across the width of the ditch 2.

In the event that the flexible mat fabric 10 needs to be set and activated as by a wetting process, the liquid dispensing mechanism 400 is actuated to dispense liquid along the flexible mat fabric 10. As mentioned, the operation of the payload release mechanism 300 and the liquid dispensing mechanism 400 can be integrated with one another or they can be independently controlled by the installation personnel assisting the driver of the vehicle 110 (e.g., as by the user interface 55). When the two mechanisms are integrated with one another, the flexible mat fabric 10 is unwound and simultaneously the liquid is dispensed onto the flexible mat fabric 10 by the liquid dispensing mechanism 400.

As described herein, the setting of the flexible mat fabric 10 results in a hardened structure being formed along the bottom of the ditch 2.

Pipeline Installation

The pipeline installation occurs between the first stage and the second stage. It is worth mentioning that the time of solidification of the flexible mat fabric 10 can be very short and if so, this short time step would accelerate the process of installation of the pipeline 1. The pipeline installation can be done by the same vehicle 110 by replacing the rod-roller 310 that holds the flexible mat fabric 10 with thermoplastic commercial spoolable pipeline. The automated vehicle 110 can be linked with a spoolable truck that contains the spoolable pipeline 1. In the event, a spoolable pipeline is used, the pipeline can be formed of a composite material.

Figure 3:
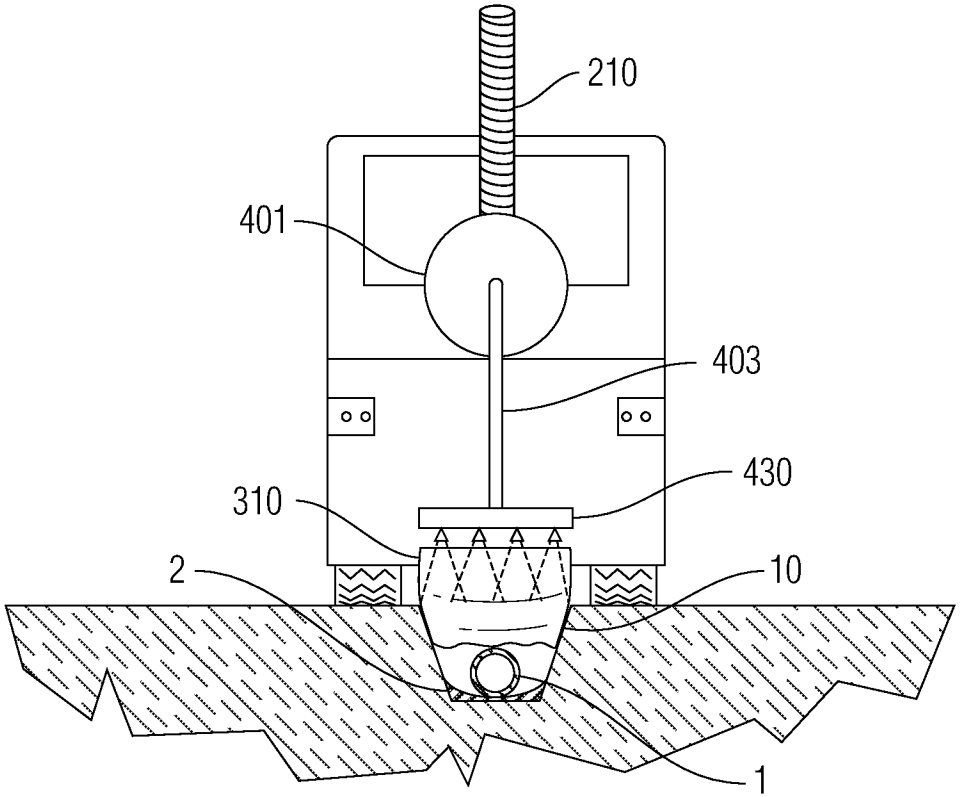
FIG. 3 is a schematic, in partial cross-section, of the automated system showing a second stage of operation.

Second Stage of Operation (FIG. 3)

In the second stage, the vehicle 110 passes over the initial excavation process to place the top layer of the flexible fabric mat 10 following similar steps described in the above first stage. FIG. 3 presents a schematic of the second stage installation. This automated installation process can be performed in any number of different settings including but not limited to a desert environment but it is not limited to that environment as it can be used in many land environments, such as a land that contains small to medium rocks, farms. etc.

Advantages

It is desirable to use composite materials in the oil and gas industry and one of the main areas where non-metallic materials are being utilized is in the pipeline sector. Installation problems are usually the main cause of premature failure in composite pipelines. The installation related failures are the result of using similar installation techniques than the ones used for steel pipelines, paradoxically the installation requirements does not differ much from one material to the other. However, the fragile nature of the composite pipelines requires special attention on the soil quality and uniform terrain at the time of installation.

The present disclosure aims to solve the problem of soil uniformity during the trench preparation, as well as reduce the time and effort required to prepare the required trench quality. The flexible fabric mat 10 ensures the proper distribution and support of the pipeline in the terrain. Besides it acts as an interphase between the soil and the pipe alleviating the soil quality requirement for the pipe installation. Also, it can be used as protective slabs on top of the pipeline 1 during the installation process.

As illustrated in the figures, the automated installation process of the flexible fabric mat 10 alleviates the needs of a detailed trenching and unnecessary utilization of resources such as specialized manpower. The automated installation process of the flexible fabric mat 10 provides ease deployment in the field of the mat with cost effective. In addition, mat installation provides a stable, flat and even surface terrain and alleviates possible bending of the composite pipelines. It also offers continuous and stable support along the line alleviating the possible flexural stresses encountered in the pipeline transitions. When the flexible fabric mat 10 is in the form of honeycomb mat with settable material (as described in the '971 application), this type of mat structure also reduces the spams due to soil settlement. The flexible fabric mat will also serve as barrier between the soil and the pipeline offering a homogeneous surface to lay down the composite pipelines 1. The utilization of the flexible fabric mat 10 will entirely eliminate the problem of the sharp objects like rocks being in contact with the composite pipe eliminating the likelihood of failure due to local wear in the pipe surface. Utilizing the automated installation process of mat during the installation reduces the time of trench preparation, and accelerates the installation process.

Additional Automated Tasks

It will be appreciated that an additional automated task that can be performed by the vehicle 110 is that the vehicle 110 can perform a backfill operation by using the adjustable knife 220 once the initial excavation and mat installation are completed if the backfilling sand is adequate to be utilized for a backfill operation in which the sand is clear without any rocks and other materials that can damage the pipeline.

In addition, the roller 310 that carried the flexible mat 10 can be replaced by a flexible pipe that is known as a reinforced thermoplastic pipe (RTP) once the mat installation is complete. Subsequently, another layer of mat can be installed on top of the RTP for laying down over the pipeline for additional protection of the pipeline. This can be performed prior to the initial purified sand backfill operation.

Figure 8:
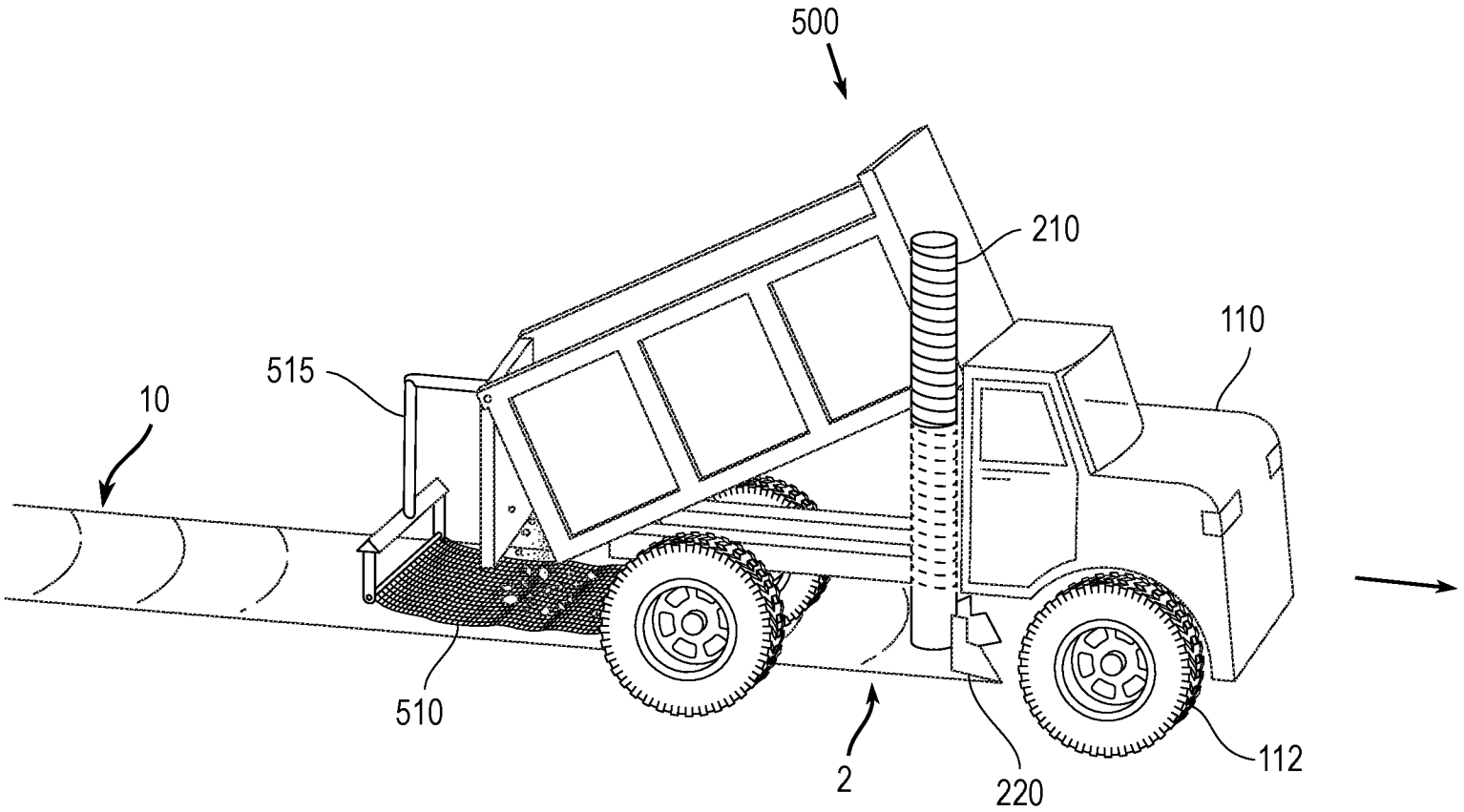
FIG. 8 is a schematic of a modified automated system showing an alternative mode of operation.

As shown in FIG. 8, another operation for the vehicle 110 is that that vehicle 110 can be modified or a different vehicle 110 can be provided for performing a sand sieving process known as Tamiz in which non-purified sand becomes purified. As mentioned above, the use of purified sand is desired for protecting the pipeline from damage from rocks. The vehicle 110 can be modified to include a bed 500 that can carry unpurified sand that typically includes small rocks and other undesired materials. A sand sieve 510 is provided at the location where the roller 310 was present with a frame 515 supporting the sand sieve 510 and suspending it behind the vehicle. The sand sieve 510 can be a mesh material having a particular mesh size. The sand sieve 510 is selected so that unpurified sand that is fed into the sand sieve is purified by passing through the sand sieve 510. Since the sand sieve 510 is suspended behind the vehicle 110, the sand passing through the sand sieve 510 drops into the prepared ditch. The unpurified sand can be delivered to the sand sieve 510 using any number of conventional techniques, including but not limited to using of conveyor mechanism and/or the bed 500 can be a movable bed that can be raised to cause the unpurified sand to drop into the sieve.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

What is claimed is:

1. A vehicle for installing in a prepared area along a ground surface a protective structural support proximate a buried pipeline in an automated manner, the vehicle comprising:

a chassis with a plurality of wheels;

a payload release mechanism coupled to the chassis and including a roller for holding the protective structural support, the payload release mechanism being configured to dispense and lay down the protective structural support in the prepared area; and a liquid dispensing mechanism that is coupled to the chassis and is located downstream of the payload release mechanism, the liquid dispensing mechanism including a liquid source and a dispenser that is in fluid communication with the liquid source and is configured to dispense liquid across a spray area.

2. The vehicle of claim 1, wherein the roller and the dispenser are spaced rearwardly from a rear end of the chassis.

3. The vehicle of claim 1, wherein the roller of the payload release mechanism is motorized in that a motor is operatively coupled to the roller such that operation of the motor results in rotation of the roller for unwinding the protective structural support along the ground surface.

4. The vehicle of claim 1, further including a main controller that is in communication with the payload release mechanism and the liquid dispensing mechanism.

5. The vehicle of claim 1, wherein the main controller is configured to simultaneously turn on both the payload release mechanism and the liquid dispensing mechanism.

6. The vehicle of claim 4, wherein the main controller is in communication with a speedometer device that detects a speed measurement of the vehicle and the payload release mechanism is operated in view of the speed measurement of the vehicle.

7. The vehicle of claim 1, wherein the dispenser comprises an elongated structure that includes a plurality of nozzles spaced along a length of the elongated structure for dispensing the liquid in a direction toward the ground surface.

8. The vehicle of claim 1, wherein the liquid source comprises water that is held under pressure.

9. The vehicle of claim 1, further comprising:

an adjustable excavating tool that is coupled to the chassis and is movable between a raised position and a lowered position.

10. The vehicle of claim 9, wherein the adjustable excavating tool is disposed upstream of the payload release mechanism and moves in a vertical direction that is perpendicular to a longitudinal axis of the vehicle.

11. The vehicle of claim 9, wherein the adjustable excavating tool includes an excavating knife that is configured for excavating a ground surface to form a ditch when the adjustable excavating tool is in the lowered position.

12. A system for installing in a prepared area along a ground surface a protective structural support proximate a buried pipeline in an automated manner, the system comprising:

a vehicle with a chassis with a plurality of wheels;

a roll of flexible fabric mat which comprises the protective structural support for installation proximate the buried pipeline;

a payload release mechanism coupled to the chassis and including a roller for holding the roll of flexible fabric mat, the payload release mechanism being configured to dispense and lay down the flexible fabric mat in the prepared area; and a liquid dispensing mechanism that is coupled to the chassis and is located downstream of the payload release mechanism, the liquid dispensing mechanism including a liquid source and a dispenser that is in fluid communication with the liquid source and is configured to dispense liquid across a spray area which covers at least a top surface of the flexible fabric mat.

13. The system of claim 12, wherein the flexible fabric mat comprises:

a first layer;

a second layer;

an intermediate spacer fabric layer that is disposed between the first layer and the second layer, the first and second layers being attached to the intermediate spacer fabric layer to form a layered structure, the intermediate spacer fabric layer comprising a flexible honeycomb or octagonal shaped spacer fabric that has a plurality of cells defined therein; and a settable material that is disposed within the cells and includes a cementitious mixture and one or more organic polymers and is settable to a hardened material.

14. The system of claim 13, wherein the first layer comprises a top layer disposed along an upper surface of the intermediate spacer fabric layer, the first layer having a mesh construction that is sized so that the hardened material is maintained within the cells, wherein the second layer comprises a bottom layer disposed along a lower surface of the intermediate spacer fabric layer, the second layer having a mesh construction that is sized so that the hardened material is maintained within the cells.

15. The system of claim 13, wherein the spacer fabric layer is formed of at least one of carbon fibers and aramid fibers.

16. The system of claim 13, wherein the intermediate spacer fabric layer comprises a flexible octagonal shaped spacer fabric.

17. The system of claim 13, wherein the cementitious mixture includes construction aggregates that are bound with a hydrolic cement that is capable of setting and hardening by hydration reactions when water is added to the cementitious mixture.

18. The system of claim 13, wherein the at least one organic polymer comprises a homopolymer, a copolymer formed when two or more monomers are polymerized, or a mixture thereof.

19. The system of claim 12, wherein the roller of the payload release mechanism is motorized in that a motor is operatively coupled to the roller such that operation of the motor results in rotation of the roller for unwinding the protective structural support along the ground surface.

20. The system of claim 12, further including a main controller that is in communication with the payload release mechanism and the liquid dispensing mechanism.

21. The system of claim 20, wherein the main controller is configured to simultaneously turn on both the payload release mechanism and the liquid dispensing mechanism.

22. The system of claim 20, wherein the dispenser comprises an elongated structure that includes a plurality of nozzles spaced along a length of the elongated structure for dispensing the liquid in a direction toward the ground surface.

23. The system of claim 12, further comprising:

an adjustable excavating tool that is coupled to the chassis and is movable between a raised position and a lowered position.

24. The system of claim 23, wherein the adjustable excavating tool is disposed upstream of the payload release mechanism and moves in a vertical direction that is perpendicular to a longitudinal axis of the vehicle.

25. The system of claim 23, wherein the adjustable excavating tool includes an excavating knife that is configured for excavating a ground surface to form a ditch when the adjustable excavating tool is in the lowered position.

26. A method for installing a protective structure to protect a pipeline comprising the steps of:

excavating a ground area in which the pipeline is to be installed;

laying down a first flexible fabric mat using an automated payload release mechanism that is part of a vehicle that travels across the ground area as the first flexible fabric mat is dispensed into the excavated ground area; and dispensing a liquid onto the first flexible fabric mat using an automated liquid dispensing mechanism that is located downstream from the automated payload release mechanism, wherein the liquid causes the first flexible fabric mat to harden and set.

27. The method of claim 26, wherein the pipeline is formed of a composite material.

28. The method of claim 26, further including a step of excavating the ground area with an excavating tool that is part of the vehicle and moves vertically between a raised position and a lowered position which contacts the ground area to form a ditch.

29. The method of claim 28, wherein the excavating tool is located upstream of the automated payload release mechanism.

30. The method of claim 26, further including the step of controlling the speed at which the payload release mechanism unrolls the first flexible fabric mat based on a speed measurement of the vehicle.

31. The method of claim 26, further including the steps of:

installing the pipeline over the first flexible fabric mat;

laying down a second flexible fabric mat over the installed pipeline using the automated payload release mechanism; and dispensing a liquid onto the second flexible fabric mat using an automated liquid dispensing mechanism that is located downstream from the automated payload release mechanism, wherein the liquid causes the second flexible fabric mat to harden and set.

* * * * *